United States Patent [19]

Dahl

[11] 4,035,858

[45] July 19, 1977

[54] PROCESS FOR THE PREUSE WORK-HARDENING OF BOLTS

[76] Inventor: Norman C. Dahl, Lexington, Mass.

[21] Appl. No.: 664,574

[22] Filed: Mar. 8, 1976

[51] Int. Cl.[2] ..... B21K 1/44

[52] U.S. Cl. ..... 10/27 H; 85/1 T; 85/62; 29/452

[58] Field of Search ..... 29/446, 452; 10/27 R, 10/27 H; 85/1 T, 62; 148/12 B

[56] References Cited

U.S. PATENT DOCUMENTS

| | | | |
|---|---|---|---|
| 2,146,825 | 2/1939 | Kinney | 10/27 H |
| 2,637,672 | 5/1953 | Losco et al. | 10/27 R |
| 2,764,514 | 9/1956 | Lee | 148/12.3 |
| 3,877,281 | 4/1975 | Shimizu et al. | 10/27 H |
| 3,943,819 | 3/1976 | Charron | 85/62 |

*Primary Examiner*—E. M. Combs
*Attorney, Agent, or Firm*—Richard P. Crowley

[57] ABSTRACT

A method for manufacturing bolts of a given grade and size in which, after forming, threading and heat treating, each bolt is work hardened by the application and subsequent removal of a tensile force of magnitude somewhat above the minimum proof load for the given grade and size of bolt, so that all bolts so treated will have the same yield point and the torque rotation curve for each bolt will have a discontinuity in slope at this common yield point.

1 Claim, 11 Drawing Figures

PROCESS FOR THE PREUSE WORK-HARDENING OF BOLTS

BACKGROUND OF THE INVENTION

Surprisingly, in this day of remarkable technological innovation, the problem of tightening a bolt so as to create in the bolt a predetermined level of tension is a problem for which there is no simple and inexpensive general solution.

The difficulty in finding a solution stems from two sources. First, while it is technically possible to make a direct measurement of the tension which a bolt carries, all such systems devised thus far are either too expensive or too delicate for widespread use. Some success has been had with fasteners designed to include special means which give some sort of indication when a particular level of tension is reached as a bolt is tightened. My U.S. Pat. Nos. 3,431,812 and 3,757,630 describe such a capability.

The second source of difficulty is the role which friction plays in threaded fasteners. As matters work out in practice, when wrenching torque is used to produce tension in a bolt only about 10 percent of the torque goes into producing tension in the bolt, the remainder going to overcome friction, about up to 50 percent to friction of the nut and bolt head bearing surfaces and up to about 40 percent to friction of the threads. This is not all bad because the helical thread is essentially an inclined plane and without friction the nut would rotate and unwind as soon as the tightening wrench is removed. What is bad about friction is that its magnitude varies considerably due to a number of causes which are difficult to control. Since the friction is difficult to control it is difficult to use the magnitude of wrenching torque as a means for reliably producing accurate bolt tension of predetermined magnitude. This problem of friction variability has been circumvented in some few designs, including those described in my patents cited above, by isolating one element in the bolt head or nut so that it is loaded only by the bolt force and undergoes observable plastic deformation when this bolt force reaches a predetermined magnitude.

There is increasing pressure to develop more accurate tensioning methods because, among other reasons, greater tensioning accuracy will reduce bolting costs by allowing the specification of higher bolt tensions, tensions close to the proof load (which is the tensile force which will produce in a bolt a specified amount of permanent elongation). Indeed, there are many users of bolts who feel that, for most applications, the solutions to the problem of producing accurate and uniform bolt tensions is to tighten each bolt until its yield point is just exceeded. The reasoning is that this yield point is an inherent property of the bolt material and, hence, if a number of bolts made of the same material are tightened under varying conditions of friction until they yield, then each will carry the same tension; namely the tension whih causes yielding of the bolt material. For example, two wrenching systems for tightening bolts in this way have been announced in the technical press recently (Machine Design, Volume 47, No. 2, Jan. 23, 1975, and Design News, Volume 30, No. 17, September 8, 1975, page 57, both incorporated by reference herein). Both systems incorporate means for measuring the wrenching torque and the rotation of the nut (or bolt) and for determining the slope of the torque-rotation curve by calculating the ratio of increments in these two measured quantitites. As the bolt tension reaches and exceeds the yield point there is a gradual, but substantial drop in this slope as the bolt material passes through the transition zone between elastic and plastic deformation. When this drop in slope reaches a predetermined value electronic circuits are triggered to stop the tightening. Other circuits then are actuated to check whether the final values of wrenching torque and nut rotation fall within predetermined limits which determine acceptability.

Too low a final wrenching torque will indicate that the bolt's yield point and, hence, final tension lies below specification, but this is not certain, since the low torque also could result from the friction being low for that particular bolt. Too high a torque will indicate that the bolt's yield point and, hence, final tension lies above specification, but again this is not certain, since the high torque also could result from the friction being high for that particular bolt. Too small a final nut rotation will mean there has been little plastic deformation and will imply that the bolt has a high hardness and hence may be brittle. Too large a nut rotation will mean there has been substantial plastic deformation and will imply that the bolt has a low hardness and hence has a low tensile strength, and may undergo excessive plastic elongation if, under service conditions, the bolt is subjected to additional increments of tension.

Such wrenching systems as described will produce uniform bolt tensions only to the extent that the bolts, as manufactured, have the same force-deformation curves beyond the elastic range. When the bolts have different force-deformation curves, which depend greatly on the hardness level to which the individual bolt is hardened, the bolt tensions produced by these wrenching systems will vary and some of the bolts will have to be removed and discarded, an expensive method of quality control, since it includes the cost of installing and removing each defective bolt. While it is possible to control material properties and heat treatment so that all bolts, as manufactured, have substantially the same force-deformation curve beyond the elastic range, the costs of maintaining such close controls would be prohibitive. To make manufacture economical, the specifications for bolts (see Metals Handbook, Volume I, Properties and Selection of Metals, 8th Edition, 1961, page 175, Table 2) give a range of hardness within which all bolts of a given grade and size must lie, and specify as the minimum values for the proof load stress and the tensle strength the values which will be possessed by the bolt having the minimum allowable hardness. That bolts of a given grade and size, as presently manufactured and sold, do have appreciable variations is attested to by measurements of hardness and tensile strength of bolts obtained from different suppliers of the same grade and size of bolt (see *Metals Handbook,* op.cit., page 178, FIG. 8).

Thus, it may be seen that the problem of securing uniform bolt tensions is not solved by tightening each bolt until its yield point is just exceeded, even with the assistance of wrenching systems such as those described above, because of the inherent variability in the yield points of bolts as presently manufactured.

SUMMARY OF THE INVENTION

My invention concerns improved metal fasteners, such as a plurality of bolts, all characterized by having the same yield point and to the process of preparing and using such fasteners. In particular, I have invented a simple and inexpensive method for treating bolts of a given grade and size in such a way that all bolts so treated will have the same yield point. Moreover, the torque-rotation curves of all such bolts will have a discontinuity in slope at this common yield point. By making minor changes in the decision circuitry of wrenching systems such as described above, it will be easy for these wrenches to locate this discontinuity and, hence, tighten all bolts to the same level of tension.

The treatment consists of subjecting all such fasteners, particularly bolts of a given grade and size, after completion of their present normal manufacturing process, to a tensile force somewhat above the minimum proof load for bolts of this grade and size and then removing this force. This treatment work hardens the material in all the bolts up to the same level of tension so that thereafter all the bolts will behave elastically up to the level of this applied tensile force and will deform plastically under any increment of force beyond this new yield point. Because the slope of the torque-rotation curve in the elastic range is much larger than the slope in the plastic range, an important practical consequence of this work hardening treatment is that for each of the bolts there will be an abrupt change in the slope of its torque-rotation curve at this new, common, yield point.

Another significant practical consequence of this treatment is that by measuring the permanent elongation accompanying the work hardening of each bolt, it will be possible to identify those bolts which have an unusually high hardness and, therefore, are brittle, and those which have a low tensile strength and, therefore, will undergo excessive plastic deformation (and may fracture) if subjected to additional increments of tension in service. Thus, with this method of pre-use work hardening the fastener manufacturer can screen out those bolts which have insufficient strength to meet the minimum tensile strength requirement as well as those bolts which work harden to the new yield point but have too high hardness. The result will be that the fastener manufacturer will be able to guarantee very close limits on the in-place bolt tensions shipped from the factory, when these bolts are tightened by wrenching systems such as those described above, independent of the friction conditions existing at the point of installation. In turn, the user will be able to design joints for substantially higher bolt loads because of the close limits guaranteed on the in-place bolt tensions. Furthermore, by purchasing only bolts which have been processed and screened by my method, the user will be sure of getting bolts of the same performance level from different fastener manufacturers. In essence, my method of pre-use work hardening and screening transfers the critical step in the production of accurate in-place bolt tensions from the unknown and varying conditions of the installation point to the known and easily conrollable conditions of the factory where the bolt is manufactured.

DESCRIPTION OF THE PREFERRED METHOD

Figure 1:
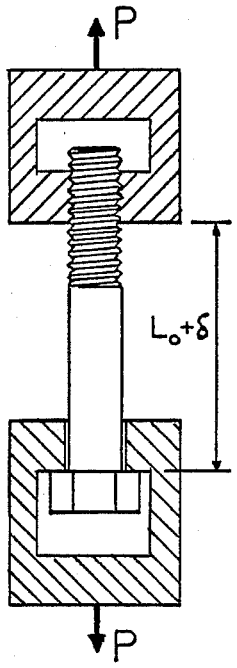
FIG. 1 is a schematic illustration of an arrangement for work hardening a bolt by pulling it in tension.
Figure 2:
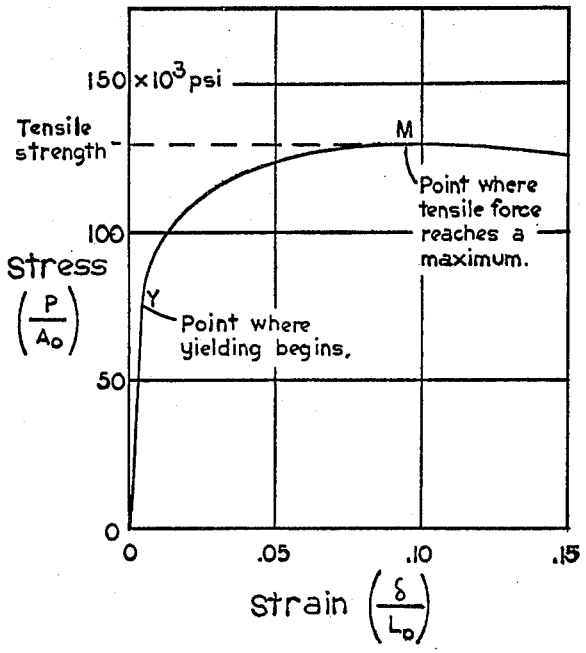
FIG. 2 is the engineering stress-strain curve for one of the steels used in making bolts.

When a bolt is subjected to a tensile test such as depicted in FIG. 1 the engineering stress-strain curve as illustrated in FIG. 2. Initially the bolt behaves elastically, and linearly, until at some stress level Y plastic deformation begins and thereafter the curve falls away from the original elastic line OY, reaching a maximum stress (called the tensile strength) at point M and then dropping until fracture occurs. It should be noted (see FIG. 6 of my U.S. Pat. No. 3,890,876) that the ture stress acting on the section of smallest diameter increases all the way to fracture. The drop in tensile force after the maximum is reached results from the fact that the area of the section of smallest diameter decreases more rapidly than the true stress acting on that area increases due to work hardening.

Figure 3:
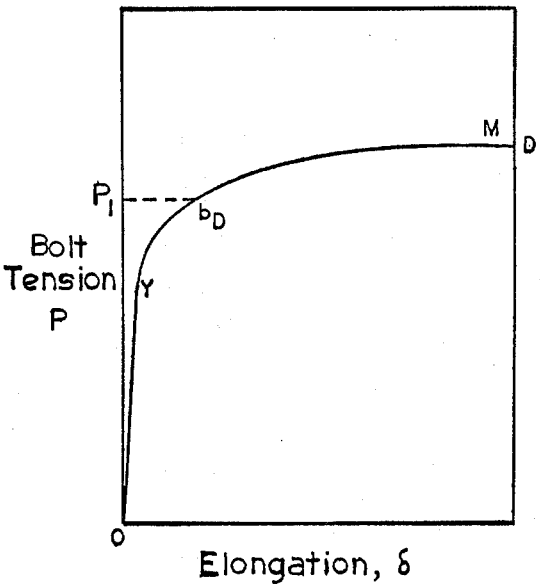
FIG. 3 depicts the shape of the load-deformation curve for a bolt made of the steel of FIG. 2.

FIG. 3 illustrates the force-deformation curve for a bolt made of the steel of FIG. 2. Let us assume that this is the force-deformation curve for bolt which is made entirely according to specifications; that is, it is made of steel with exactly the specified chemical composition and it is heat treated precisely to the specified hardness. This bolt will be designated as the design bolt D. The bolt behaves elastically up to the point Y, where yielding begins and then starts to deform plastically. By way of illustration, a tension of magnitude $P_1$ is required to reach the point $b_D$ on the curve.

Figure 4:
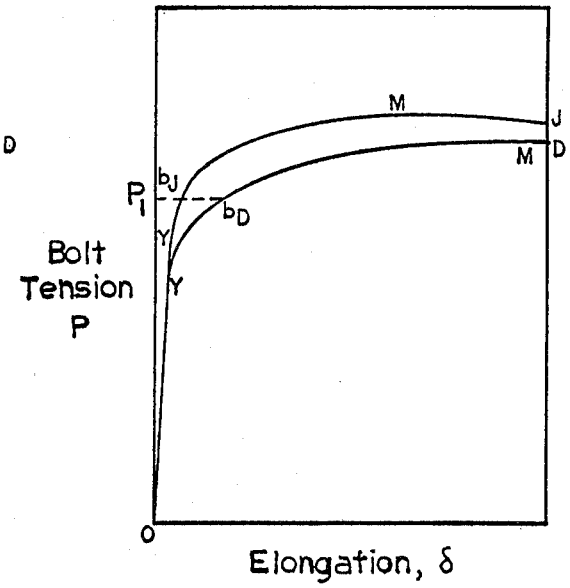
FIG. 4 depicts the curve of FIG. 3 and the curve of another bolt of somewhat greater hardness and, therefore, somewhat higher stress behavior.

FIG. 4 shows the design curve D as well as the curve J for another bolt which is assumed to have somewhat greater than the design level of hardness and therefore somewhat higher stress behavior. As a consequence of the greater hardness the maximum force capacity of the bolt J is reached at somewhat less elongation than the maximum for curve D.

Figure 5:
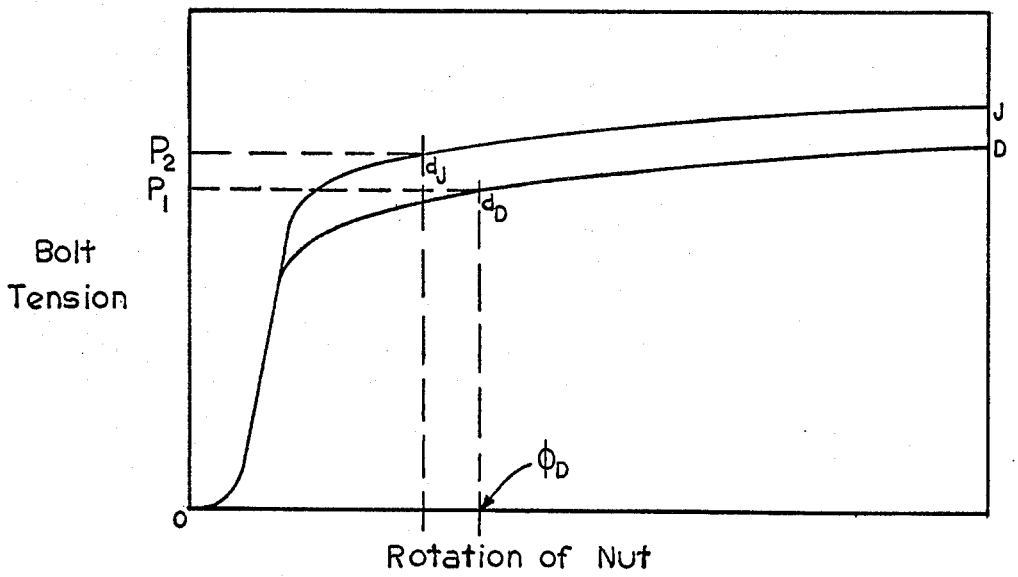
FIG. 5 depicts the relation between bolt tension and nut rotation as the two bolts of FIG. 4 are tightened to produce a maximum elongation about half that illustrated in FIG. 4.

FIG. 5 shows how the tensions in bolts D and J of FIG. 4 increase with nut rotation during tightening.

There is an initial angle of nut rotation during which the relation between bolt tension and rotation is non-linear as the various bearing surfaces in the joint are brought into firm contact. Thereafter, the bolt tension increases linearly with nut rotation until the bolt begins to yield, after which the plastic deformation causes the tension to increase less rapidly with nut rotation, resulting in rapidly decreasing slope of the curve. By way of illustration, the tension in bolt D reaches the level $P_1$ at a nut rotation of $\phi_D$.

Figure 6:
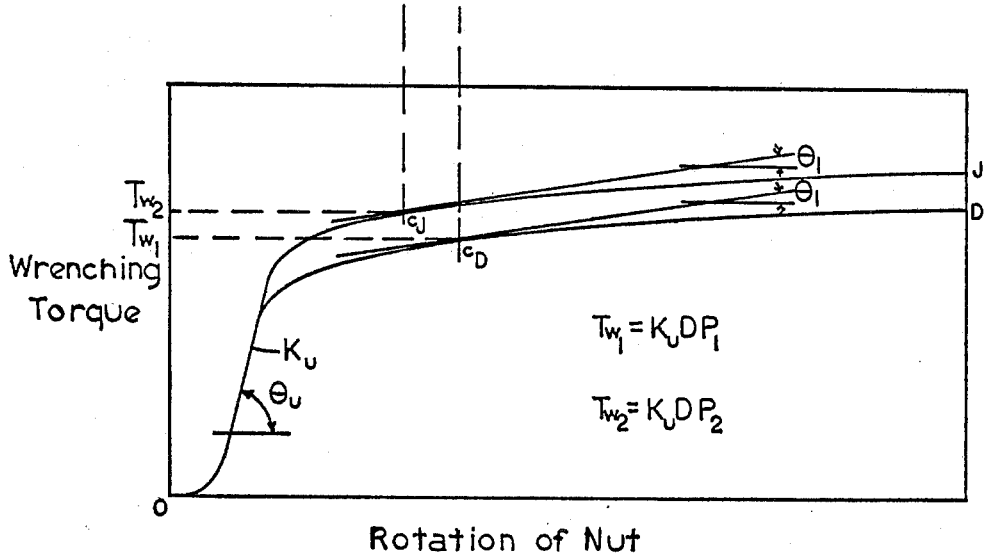
FIG. 6 depicts the relation between wrenching torque and nut rotation as the two bolts of FIG. 4 are tightened to produce a maximum elongation about half that illustrated in FIG. 4, under constant conditions of friction.

FIG. 6 shows how the wrenching torques needed to turn the nuts on the bolts D and J increases with nut rotation during tightening under constant conditions of friction. For any given angle of nut rotation the ordinates of the curves of FIG. 6 are proportional to the ordinates of the curves of FIG. 5 because of the fact that the wrenching torque is proportionally related to the bolt tension (see Machine Design, Volume 47, No. 5, March 6, 1975, page 79) as follows $$T_w = KDP \quad (A)$$

where D is the nominal bolt diameter and K is an experimentally determined torque coefficient which for normally dry surfaces and normal unlubricated bolts is usually about 0.2.

Let us assume that a wrenching system such as described earlier has its triggering circuits set to stop tightening when the slope of the torque-rotation curve reaches the value tangent $\theta_1$, based on the aim to produce the tension $P_1$ in the design bolt D. When used to tighten the bolt D this wrench will shut itself off automatically when the slope angle $\theta_1$ is reached at point $c_D$ on the D curve where the wrenching torque is $T_{w1}$ and, as may be seen from FIG. 5, the bolt tension is $P_1$. However, when used to tighten the bolt J, which has a higher stress behavior than bolt D, the wrench will shut itself off at the point $c_J$ on the J curve where the bolt tension is $P_2$ which is higher than $P_1$.

Thus, it may be seen that variations in the force-deformation curves of different bolts, resulting from variations in the steel composition or variations in heat treatment, will lead to the production of different in-place tensions in bolts tightened to just beyond their yield point. The designers of the afore-described wrenching systems recognized that the economics of bolt manufacture preclude extremely close tolerance on these variations and therefore provided means for checking that the final values of wrenching torque and nut rotation fall within predetermined limits so that bolts whose force-deformation variation brought them outside these limits could be identified and removed and discarded.

Figure 7:
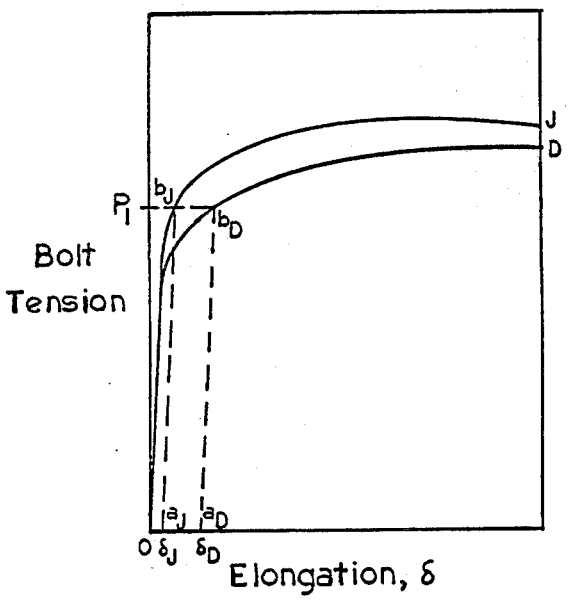
FIG. 7 depicts the behavior of the two bolts of FIG. 4 when they are work hardened in tension to the Force level $P_1$ and the force then is removed.

Turning now to the detailed description of my invention, FIG. 7 depicts the behavior of the bolts D and J when they are work hardened by being subjected to a tension which rises to the level $P_1$ and then decreases to zero. A wide range of technology for applying and controlling forces to close tolerances is available in the market so the tension $P_1$ can be applied economically to any required degree of accuracy. The bolt D is at the point $b_D$ when the tension $P_1$ acts. As the tension is reduced to zero the bolt relaxes elastically along the line $b_D a_D$ parallel to the initial elastic portion of the curve D, and is left with premanent elongation of $\delta_D$. Similarly, bolt J is at $b_J$ when $P_1$ acts and relaxes to point $a_J$ when the tension drops to zero, with permanent elongation $\delta_J$.

Figure 8:
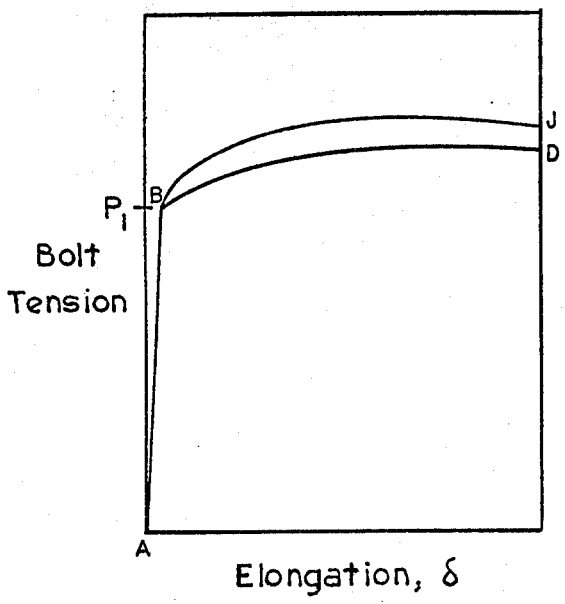
FIG. 8 depicts the load-deformation curves of the two bolts of FIG. 4 after they have been work hardened to the force level $P_1$ as depicted in FIG. 7.

FIG. 8 illustrates the behavior of the bolts D and J when they again are loaded in tension after having been work hardened to the level $P_1$. Both bolts behave elastically along the line AB until the tension reaches the level $P_1$. For increments of tension beyond $P_1$ the bolts deform plastically and the curves resume the shapes, respectively, beyond the points $b_D$ and $b_J$ in FIG. 7. The essential point is that the force-deformation curves for both of the work hardened bolts have a discontinuity in their slope at the point B, that is, at the tension level $P_1$ to which they previously have been work hardened. It is this discontinuity in slope which will be exploited in tightening both bolts to the tension level $P_1$.

Figure 9:
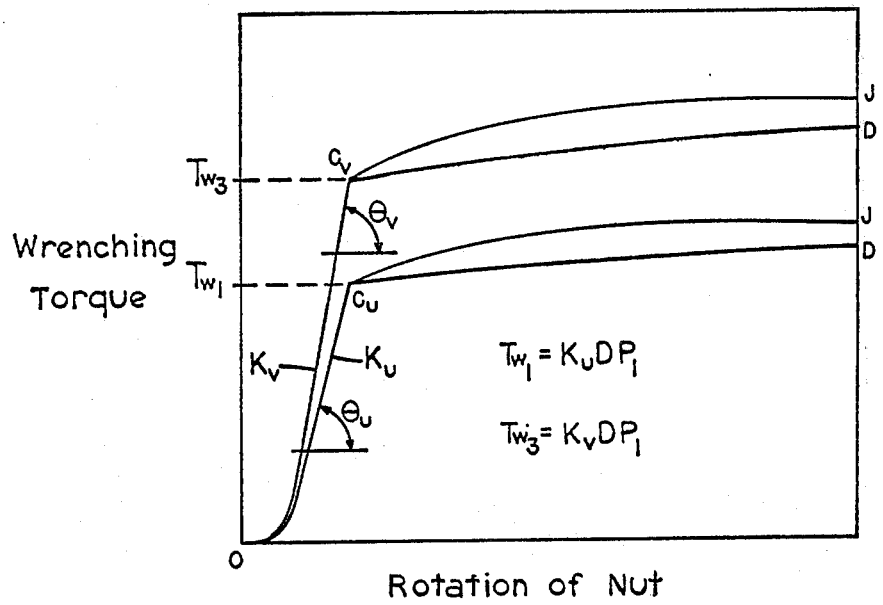
FIG. 9 depicts the relation between wrenching torque and nut rotation when the two bolts of FIG. 8 are being tightened so as to produce a maximum bolt elongation about half that illustrated in FIG. 8, under two different conditions of friction.

FIG. 9 shows how the wrenching torques needed to turn the nuts on the bolts D and J of FIG. 8 increases with nut rotation during tightening under two different conditions of friction. It may be seen that when the tension in either bolt reaches and just exceeds the level $P_1$ there will be a sharp discontinuity in the slope of the torque-rotation curve. The discontinuity in slope will be of different amount for bolts which have different force-deformation curves, but in all cases the change in slope will be large. For example, in FIG. 9 as the tension in bolt D, being tightened under friction $K_U$, passes through $P_1$ (e.g., as the curve goes through the point $c_U$) the slope of the torque-rotation curve drops by a factor of about 20. Similarly, the slope of the torque-rotation curve for bolt J drops by a factor of about 10. The effect of the level of friction is only to raise (as illustrated for $K_V$) or lower the wrenching torque level at which the slope discontinuity occurs.

These discontinuities in slope will be easy to locate with wrenching systems such as those described earlier. The decision circuitry does not have to locate a point on the torque-rotation curve, such as point $c_D$ in FIG. 6, where the slope is some specified fraction of the slope measured in the elastic region. Rather, the circuitry only need search for a sharp drop in the slope measured in successive increments of nut rotation and then signal for the wrench to be shut off when this drop in slope equals or exceeds a preset value, say, for purposes of illustration, when the slope drops by a factor of 5 or more.

Figure 10:
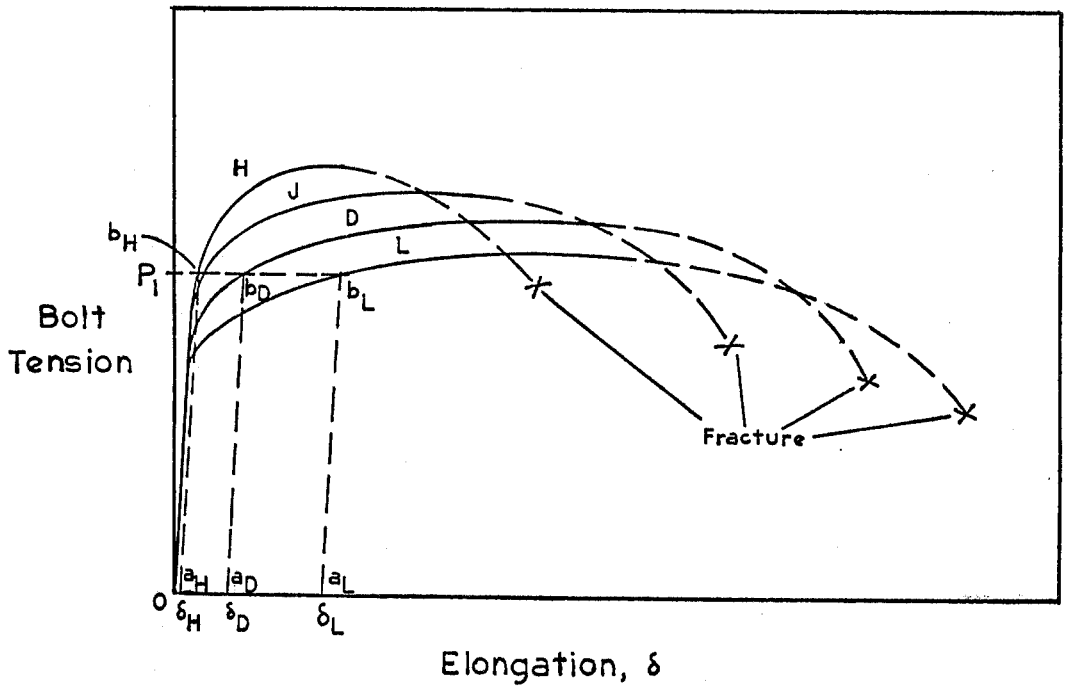
FIG. 10 depicts the general load-deformation behavior of the two bolts of FIG. 4 and of two other bolts in tensile tests when the tests are carried to fracture and, additionally, depicts the behavior of the two other bolts when they are work hardened to the force level $P_1$ and the force then is removed.

It will not be necessary for the wrenching system to have circuits which are actuated to check whether the final values of wrenching torque and nut rotation fall within predetermined limits. Such checks will not be required because the quality control on the bolts will be done in the bolt factory in connection with the work hardening process. The criteria used for quality control are depicted in FIG. 10 which shows the load-deformation curves for the bolts D and J, when they are tested all the way to fracture, as well as the curves for two other bolts, H and L. Curve H illustrates a bolt whose hardness is above the design level and curve L illustrates a a bolt whose hardness is below the design level but not so low that its tensile strength is below the design yield point (proof load). It will be noted that as the hardness increases both the tensile strength and the yield point increase and, also, the ductility decreases so that the maximum load point occurs after less elongation and the elongation at fracture is less. The curves are shown dotted after their maximum because the shape of this part of the curve depends upon the length of the bolt.

When the bolts are being work hardened any bolt whose tensile strength is below the design yield point will fracture and be discarded. For all other bolts a measurement will be made of the permanent elongation incurred during work hardening to the tension $P_1$. This elongation can be measured while the bolt is at tension $P_1$, i.e., at points $b_H$, $b_D$ and $b_L$, or after the tension has been reduced to zero, i.e., at points $a_H$, $a_D$ and $a_L$. By making tension and hardness tests on bolts heat treated to various levels of hardness it will be possible to determine the limits of elongation which define bolts which have too high or too low hardness. If we assume, for purposes of illustration, that the elongations $\delta_H$ and $\delta_L$ in FIG. 10 represent these limits then all bolts which have an elongation smaller than $\delta_H$ or larger than $\delta_L$ will be discarded. By this means of work hardening treatment and inspection all bolts shipped from the factory can be guaranteed to have the same yield point and to be within a hardness range which will ensure that none of the bolts will be brittle and none will undergo excessive elongation if, under service conditions, the bolt is subjected to increments of tension beyond the yield point.

To illustrate how my method will work in practice, consider the concrete example of pre-use work hardening of three-quarter inch, grade 5 bolts made of 1038 steel. The specifications (see Metals Handbook, op.cit., page 175, Table 2) state that such bolts should have a minimum proof load stress of 85,000 psi, a minimum tensile strength of 120,000 psi and a hardness range of Rockewll C23 to 32 in the threaded section. From data on the relation between hardness and tensile strength for three-quarter inch, grade 5 bolts made of 1038 steel (see Metals Handbook, op.cit., page 177, FIGS. **6*b* and 6*c*), it may be seen that the hardness range Rockwell C23 to 32 corresponds to a tensile strength range of approximately 120,000 psi to 145,000 psi. In an actual application, data would also be obtained on the relation between proof load stress and hardness so that the proper level could be set for the work hardening tensile force. For purposes of the present illustrative example, if it is assumed that the ratio of proof load to tensile strength remains substantially constant over the hardness range Rockwell C23 to 32, bolts with the maximum allowable hardness of Rockwell C32 will have a proof load stress of approximately 103,000 psi, corresponding to a proof load of 34,400 lb. If a tensile force of 34,400 lb. is used for the work hardening, then the bolts with hardness Rockwell C32 should elongate permanently 0.0005 inches per inch of bolt length between the nut and bolt head bearing surfaces (see Metals Handbook, op.cit., page 174), and bolts with permanent deformation smaller than this would be discarded. The permanent elongation of bolts with hardness Rockwell C23 would be determined experimentally and bolts with elongation larger than this would be discarded. If it were decided that that the proof load stress of 103,000 psi was too high relative to the minimum tensile strength of 120,000 psi, then a lower work hardening proof load stress, say 95,000 psi, could be selected. It then would be necessary to determine experimentally the permanent elongations for bolts having hardnesses Rockwell C23 and 32** and use these values to define, respectively, the upper and lower limits of the range of acceptable permanent elongation for bolts work hardened to 95,000 psi.

The foregoing exposition has not taken account of the fact that when a bolt is tightened with a wrench it is subjected to a twisting torque as well as a tension. It is necessary to examine whether this fact will vitiate the basic conclusion that if bolts are work hardened in tension to somewhat above the minimum proof load for bolts of this grade and size than all such bolts can be tightened to the same in-place bolt tension under all conditions of friction.

The wrenching torque required to tighten a bolt to tension P is proportional to that tension, as given by equation (A)

$$T_w = KDP \tag{A}$$

As stated earlier, about 10 percent of this torque goes into producing tension in the bolt, about 40 percent is absorbed in friction between the nut and bolt threads and 50 percent in friction between the nut bearing face and its abutting surface. Thus the torque $T_B$ acting on the bolt itself, as illustrated in FIG. 11, is approximately 50 percent of the wrenching torque, or $$T_B = \frac{T_w}{2} = \frac{KDP}{2} \tag{B}$$

Figure 11:
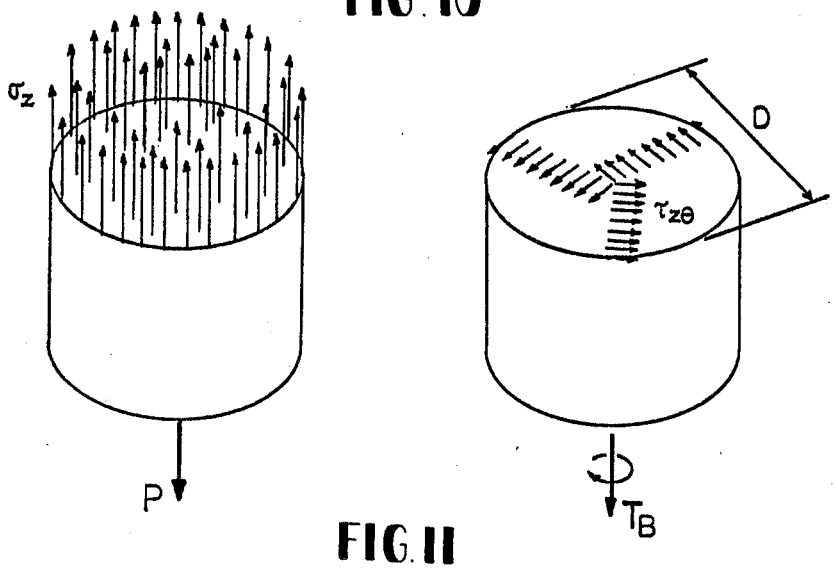
FIG. 11 depicts stresses assumed to be acting when a bolt yields during tightening under the influence of a tension P and a torque $T_B$.

For a situation, such as illustrated in FIG. 11, where a cylindrical shaft is subjected only to a tensile stress $\sigma_z$ and a shear stress $\tau_z\Theta$, the metal will deform plastically at any point (see *Mechanical Behavior of Materials*, F. A., McClintock and A. S. Argon, Addison-Wesley Publishing Company, Reading, Mass., 1966, page 277) when the stresses at that point satisfy the Mises yield criterion $$\sigma_z^2 + 3\tau_z\Theta^2 = \sigma^2 \tag{C}$$

where $\sigma$ is the yield stress in simple tension. In order to use equation (C) it is necessary to make some assumptions about the distribution of stresses over the bolt cross section, and the assumption will be made that both the tensile stress and shear stress are uniform across the shaft, as illustrated in FIG. 11. With this assumption the tensile stress can be seen to be $$\sigma_z = \frac{4P}{\pi D^2} \tag{D}$$

and the shear stress (see *An Introduction to the Mechanics of Solids*, S. H. Crandall and N. C. Dahl, McGraw-Hill Book Company, New York, 1959, pages 256–257) will have the value $$\tau_{z\theta} = \frac{12T_B}{\pi D^3} \tag{E}$$

Substituting the value of $T_B$ from equation (B) the shear stress becomes $$\tau_{z\theta} = \frac{6KP}{\pi D^2} \tag{F}$$

Since the bolt has been work hardened in simple tension by the force $P_1$ the yield stress in the work hardened bolt is $$\sigma = \frac{4P_1}{\pi D^2} \tag{G}$$

Substituting equations (D), (F) and (G) in equation (C) and simplifying, the following result is obtained for the tension in the bolt when yielding occurs during tightening $$P = \frac{P_1}{\sqrt{1 + \frac{27}{4} K^2}} \quad \text{(H)}$$

Taking the average value of 0.2 for the torque coefficient K, the bolt tension at yielding will be $$P = 0.89\ P_1$$

If the friction coefficient is assumed to vary upwards by 25 percent, to the value of 0.25, then the bolt tension at yielding will be $$P = 0.84\ P_1$$

which is a variation of only about 5.6 percent. If the friction coefficient is assumed to vary downwards by 25 percent, to the value of 0.15, then the bolt tension at yielding will be $$P = 0.93\ P_1$$

which is a variation of only about 4.5 percent.

Summarizing these calculations, it may be seen that for conditions of constant friction the fact that the bolt also is subjected to a twisting torque does not prevent all bolts from being tightened to the same in-place bolt tension, although under average conditions of friction this in-place tension will be about 11 percent less than the work hardening tension. When the friction varies about this average condition by 25 percent the in-place bolt tensions at yielding will vary by about 5 percent. In constrast, if the bolt were being tightened in the elastic region the variation in bolt tension would be the same as the variation in the torque coefficient, namely 25 percent. Thus, while there is some variation in in-place bolt tensions as a result of variations in friction, these tension variations are smaller, by a factor of about 5, than tension variations obtained with methods in which the tightening is done in the elastic range to a given level of wrenching torque.

Having described my invention, what I now claim is:

1. In a method for manufacturing bolts of a given grade and size having a minimum proof load which method comprises the steps of forming blanks into bolts having heads and shanks, threading said shanks, and heat treating the formed bolts, wherein the improvement comprises work hardening each bolt by applying and subsequently removing a tensile force of uniform magnitude somewhat above the minimum proof load for the given grade and size of bolt, so that all bolts so treated will have the same yield point and the torque-rotation curve for each bolt will have a discontinuity in slope at this common yield point.

* * * * *